United States Patent [19]

Mason

[11] Patent Number: 4,519,336

[45] Date of Patent: May 28, 1985

[54] REAR EXTENSION FOR BOAT HULL

[76] Inventor: David A. Mason, 48 Maple Ave., Smiths Falls, Ontario, Canada, K7A 2A5

[21] Appl. No.: 526,020

[22] Filed: Aug. 23, 1983

[30] Foreign Application Priority Data

Jun. 14, 1983 [CA] Canada ..... 430331

[51] Int. Cl.[3] ..... B63B 1/22

[52] U.S. Cl. ..... 114/286

[58] Field of Search ..... 114/145 A, 145 R, 271, 114/284, 285, 286, 287, 126, 140

[56] References Cited

U.S. PATENT DOCUMENTS

| | | | |
|---|---|---|---|
| 2,218,264 | 10/1940 | Luce | 114/285 |
| 2,807,228 | 9/1957 | Vandre | 114/145 R |
| 3,159,131 | 12/1964 | Frederick | 114/285 |
| 3,313,262 | 4/1967 | Yunker et al. | 114/287 |
| 3,404,651 | 10/1968 | Jensen et al. | 114/287 |
| 3,650,310 | 3/1972 | Childress | 114/286 |
| 3,760,758 | 9/1973 | Banner | 114/285 |

FOREIGN PATENT DOCUMENTS

| | | | |
|---|---|---|---|
| 1338901 | 4/1963 | France | 114/285 |

*Primary Examiner*—Trygve M. Blix
*Assistant Examiner*—Stephen P. Avila
*Attorney, Agent, or Firm*—Lowe King Price & Becker

[57] ABSTRACT

An attachment for forming a rearward extension of the hull of a boat is secured to a transom of the boat to form an extension of an underside portion of the hull and comprises a hollow body having a substantially flat surface and a bottom surface shaped to conform to the after end of the hull underside portion. A forward portion of the top surface of the hull extension is pivotally connected to the transom to allow pivotation of the extension between a lowered position, for cruising and rough weather conditions, and a raised position, for planing, in which the top surface of the hollow body is located adjacent the transom. A hydraulic piston and cylinder device is provided for effecting the pivotation of the hollow body.

9 Claims, 3 Drawing Figures

REAR EXTENSION FOR BOAT HULL

FIELD OF THE INVENTION

The present invention relates to a hull extension attachment for securement to the transom of a boat and to a boat provided with such an attachment.

More particularly, the present invention relates to an attachment for forming a rearward extension of an underside portion of a hull of a boat, the extension being pivotal from a lowered position, in which it is employed for cruising and poor weather conditions, and a raised position, in which it is disposed adjacent the transom of the boat to facilitate planing of the boat.

DESCRIPTION OF THE PRIOR ART

In the past, various attachments for the sterns of boats have been proposed for stabilizing the boats, the attachments being pivotal between raised and lowered positions.

For example, U.S. Pat. No. 2,815,521, issued Dec. 17, 1957 to R. B. Alexander teaches a stabilizer designed for attachment to the sterns of power boats in the small or medium class to ensure the boat's operating on an even keel regardless of the position or location of the load or cargo carried thereby, the stabilizer being described as resulting in a reduction in drag and water resistance due to the lifting power created by the forward motion of the boat and turbulent water caused by the operation of the propeller, which is usually located directly beneath the stabilizer. This prior boat stabilizer comprises a pair of wide blades of identical construction, the blades being pivotally connected to the stern of the boat at opposite sides of the keel of the boat.

U.S. Pat. No. 2,567,744, issued Nov. 27, 1951 to E. S. Anderson discloses a boat extension attachment intended to damp longitudinal vibration of a boat and comprising a plate-like structure attached to the transom and constituting an extension of the bottom of the boat, the plate-like structure being angularly adjustable relative to the hull, the plate-like structure comprising two separate plates mounted on opposite sides of a propeller shaft casing and being hinged to a transom of the boat, each of the plates being provided with a telescoping structure provided with a set of screw of adjusting the angle of pivotation of the respective plate.

Other attachments comprising plates pivotally secured to the stern of boats are disclosed in U.S. Pat. Nos. 2,218,264, issued Oct. 15, 1950 to H. H. Luce; 3,046,928, issued July 31, 1962 to J. F. Sherrill; 3,468,278, issued Sept. 23, 1969 to F. T. Kercheval; 3,577,948, issued May 11, 1971 to Ellsworth J. Frey and 3,602,178, issued Mar. 27, 1970 to William B. White.

U.S. Pat. No. 2,985,130, issued May 23, 1961 to J. H. Jacobs et al relates to a power boat equipped with adjustable planing floats for providing additional displacement to stabilize the boat and for shifting the planing angle of the boat, the floats comprising a pair of identical float members in the form of elongated hollow bodies each having an inclined forward wall and being pivotally connected at the lower forward edges of the float members to the rear of the transom of the boat.

SUMMARY OF THE INVENTION

It is an object of the present invention to provide a novel and improved hull extension for a boat which, in a lowered position, forms a rearward extension of an underside portion of the hull of a boat for cruising and poor weather conditions and which can be raised to facilitate planing.

According to the present invention, a hull attachment for the transom of a boat comprises a hollow defining a substantially flat top surface and a bottom surface shaped to form a rearward extension, beyond the transom, of the bottom of the hull of the boat. Means are provided for pivotally connecting a forward edge of the top surface of the hollow body to the transom and means are connectible to the hollow body and the boat for pivoting the hollow body about the pivot means between a lower position, in which a forward edge of the hollow body bottom surface is disposed adjacent and in alignment with the hull bottom and a raised position in which the hollow body top surface is disposed adjacent the transom.

Thus, with the hollow body in its lowered position, the forward end of the hollow body is disposed in at least substantially face-to-face adjacent relationship with the transom of the boat, and this arrangement is facilitated by pivotally connecting the forward edge of the top surface of the hollow body in the transom.

The hull extension may be provided in combination with the boat or may be manufactured and sold separately from the boat for attachment to the boat by the end user. When the hollow body is pivoted from its lowered position to its raised position, the location of the pivot means at the forward edge of the top surface of the hollow body enables the top surface of the hollow body to be moved into substantially face-to-face, adjacent relationship with the transom of the boat so that the hollow body is lifted clear of the above-mentioned underside portion of the boat hull. With the hollow body thus raised, the boat is ready for planing.

The invention will be more readily understood from the following description of a preferred embodiment thereof given, by way of example, with reference to the accompanying drawings, in which.

Figure 1:
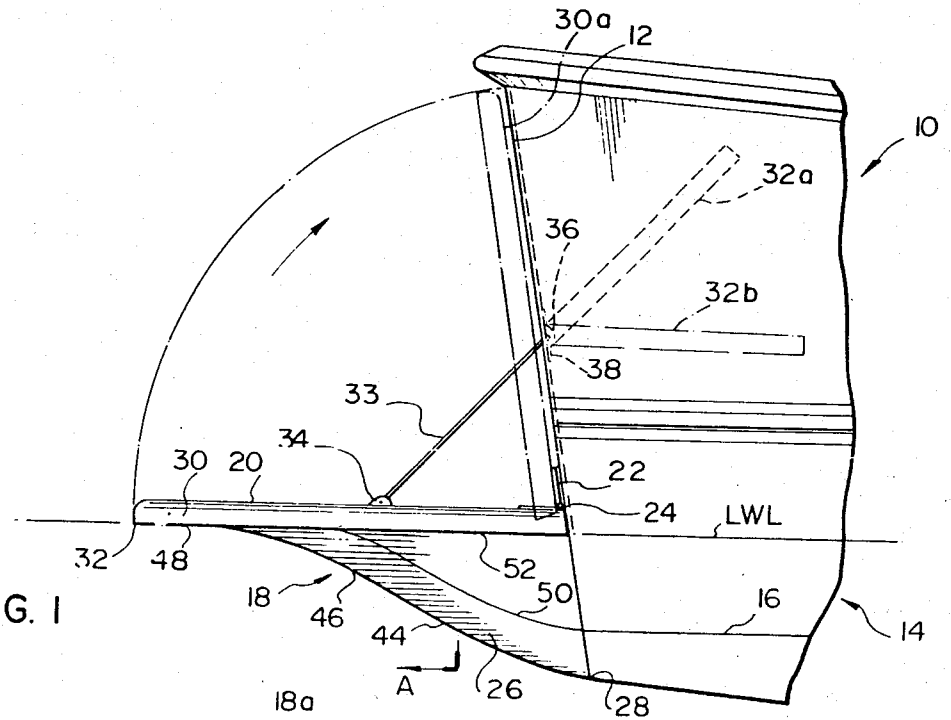
FIG. 1 shows a broken-away view of an aft portion of a boat hull provided with a hull extension attachment embodying the present invention.

In FIG. 1, reference numeral 10 indicates generally a broken-away stern portion of the hull of a boat provided with a transom 12. The waterline of the boat is indicated at LWL, and an underside portion of the boat hull is indicated generally by reference numeral 14 and has a chine 16.

A hull extension indicated generally by reference numeral 18 has a flat top surface 20 and is pivotally secured to the outer surface of the transom 14 by means of a hinge 22 at a forward end 24 of the top surface 20.

The hull extension 18 has a bottom surface 26 which is rearward and upwardly curved at an inclination from a forward edge 28 thereof towards the top surface 20, the bottom surface 26 being shaped to conform to and to form a rearward continuation or extension of the underside portion 14 of the boat hull and being smoothly streamlined to reduce turbulence, and thus to reduce drug, during motion of the boat hull in a forward direction with the hull extension 18 in the lowered position in which it is shown in full lines in FIG. 1.

The hull extension is pivotable, about the axis of the hinge 22 at the forward edge 24 of the top surface 20 of the hull extension 18, between the lowered position and a raised position. More particularly, the top surface 20 is formed on an upper portion 30 of the hull extension 18, the undersurface 32 of the top portion 30 being aligned with the waterline LWL when the hull extension 18 is in its lowered position. When the hull extension is in its raised position, the top surface 20 of the hull extension 18 lies against the outer surface of the transom 12, with the hull extension top portion 30 in the position shown in chain-dotted lines and indicated by reference numeral 30*a*, i.e. with the surface 20 disposed adjacent and in face-to-face relationship with the outer surface of the hull transom 12.

For raising and lowering the hull extension 18 between its raised and lowered positions, there is provided a piston and cylinder device comprising a cylinder shown in broken lines in a first position and indicated by reference numeral 32*a* and containing a piston (not shown) provided with a piston rod 33, which is pivotally connected at its outermost end to a bracket 34 secured to the top surface 30 of the hull extension 18.

The piston rod 33 extends through an opening (not shown) formed in the transom 12, and the cylinder 32*a* is pivotally connected to a bracket 36 provided on a plate 38 which fits over this opening in the transom 12 and is provided with a seal (not shown) for sealingly engaging the cylinder 32*a* while allowing pivotal movement of the piston rod 33 during the pivotation of the hull 18 between its lowered and raised positions. By extension and retraction of the piston rod 33 relative to the cylinder 32*a*, the pivotation of the hull extension 18 is effected and, during such pivotation, the cylinder is pivoted about the pivot axis of its connection to the bracket 36 between the position indicated by reference numeral 32*a* and a second cylinder position shown in chain-dotted lines and indicated by reference numeral 32*b*.

Figure 2:
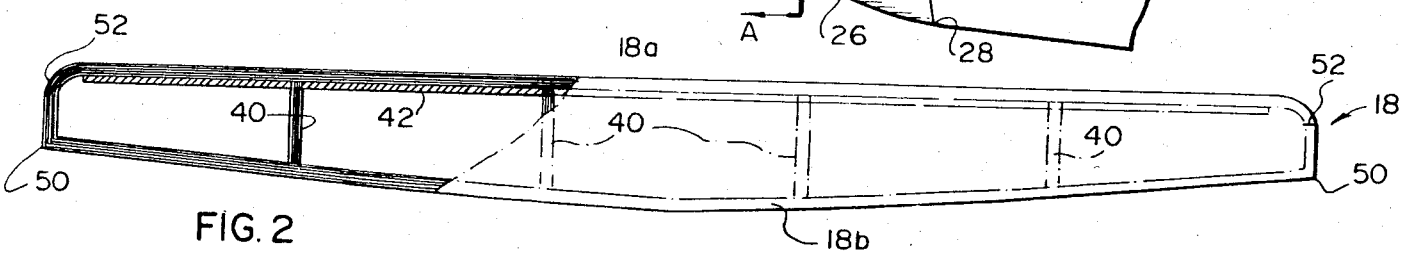
FIG. 2 shows a view taken in cross-section along the line A—A of FIG. 1 through the hull extension attachment.
Figure 3:
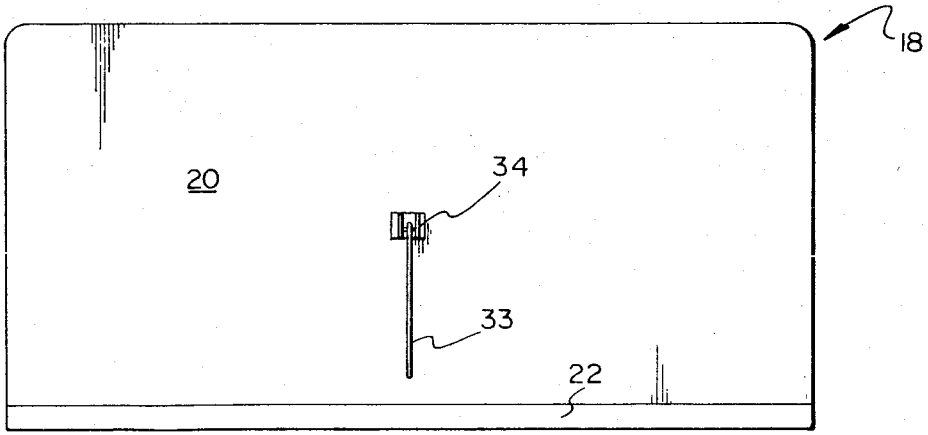
FIG. 3 shows a plan view of the hull extension of FIG. 1.

As can be seen from FIG. 2, the hull extension 18 is constructed in the form of a hollow body.

More particularly, the hull extension 18 is formed from a skin comprising, in the present embodiment of the invention, a fiberglass and balsa wood laminate and is reinforced by four stringers 40 of marine grade plywood and also by a plate 42 of plywood secured beneath the top of the hollow body and serving as a reinforcement for attachment of the hinges 22 and the bracket 34.

The hinge 22 is a continuous hinge and, like the forward edge of the top surface 20 of the hull extension 18 extends the full width of the transom at the leading edge 24.

When the hull extension 18 is in use, it is secured in its lowered position for cruising and for bad weather conditions, and in this position provides greater stability for the boat and also, due to the streamline shape of the underside of the hull extension and the conformity of the hull extension 18 with the underside portion 14 of the boat hull, substantially reduces turbulence at the stern of the boat and, thus, reduces the drag exerted on the boat by the water as the boat is propelled through the water.

Furthermore, in this position, the top surface 20 of the hull extension 18 constitutes a convenient diving platform.

When the hull extension 18 is moved into and secured in its raised position, the boat is thereby prepared for planing.

As can readily be seen from FIG. 1, the underside of the hull extension 18 as seen in side elevation, has a downwardly convexly curved portion 44, followed by a downwardly concavely curved portion 46 merging smoothly with a downwardly flat portion 48 and, thus, presents a streamlined shape to reduce turbulence in the wake of the boat. The chine 16 of the boat hull is continued as a chine 50 on the hull extension 18.

With the hull extension 18 in its raised position, the forward edge 28 of the hull extension is raised to or slightly above the waterline LWL to avoid the drag which would be caused if the lower front portion of the hull extension were immersed to any substantial extent in the water. The elevation of the forward edge 28 of the hull extension 18 when the latter is in its raised position may be increased by making the transom 12 vertical.

The hull extension is made in two parts, namely a top part 18*a* and a bottom part 18*b*, which are joined along a horizontal peripheral joint line 52.

While only one piston and cylinder device is provided in the present embodiment for raising and lowering the hull extension 18, two or even more of such devices may be provided if required. Alternatively, a manually operable screw device, a block and tackle or other suitable mechanism may be provided for raising and lowering the hull extension and suitable latching or other retaining devices (not shown) may be provided for locking the hull extension in its raised and lowered positions. Preferably, but not essentially the means for raising and lowering the hull extension 18 are operable from a steering position in the boat.

Also, the underside of the hull extension 18 could be curved downwardly at its rear end to increase lift.

The hull extension 18 may be provided as part of a new boat or as an attachment for use with an existing boat.

As will be apparent to those skilled in the art, the present hull extension enables a boat having a planing hull to operate as one having a displacement hull and, in fact, can be employed with either of these hull types.

The hull extension may be provided in two separate portions with a space therebetween to accommodate a stern drive, and the two separate portions may in that case be connected to one another so as to be raised and lowered together by a single hydraulic ram or other mechanism.

Also the bottom after end or ends of the extension or extension portions may be provided with a plate of steel or other suitable material to serve as trim tabs or the like for changing the trim of the boat while under power and in response, e.g. to hydraulic control.

While a preferred embodiment of the invention has been illustrated in the drawings and described above, it is to be understood that the invention is not restricted to the features of this preferred embodiment but may be varied within the spirit and scope of the appended claims.

I claim:

1. A hull extension attachment for the transom of a boat, said attachment comprising:

a hollow body;

said hollow body defining a substantially flat top surface, a forward end and a bottom surface, and shape to form a continuous rearward extension, beyond the transom, of the shape of a bottom portion of the hull of said boat;

means for pivotally connecting a forward edge of said top surface to the transom; and means connectible to said hollow body and said boat for pivoting said hollow body about said pivot means between (1) a lowermost position, in which said forward end of said hollow body is in face-to-face abutment with said transom from the bottom of said transom at least to the waterline of said boat, and in which a forward edge of said hollow body bottom surfacce is disposed adjacent and in alignment with said boat hull bottom surface and said hollow body top surface projects horizontally from said transom, and (2) a raised portion in which said hollow body top surface is disposed at least substantially adjacent and facing said transom;

said bottom surface of said hollow body being upwardly and rearwardly inclined from the remainder of said boat hull bottom surface to establish substantially laminar water flow when said hollow body is in its lowermost position.

2. An attachment as claimed in claim 1, wherein said hollow body bottom surface is rearwardly and upwardly inclined from said forward edge thereof towards said top surface to reduce drag on the boat when said attachment is in use in its lowered position.

3. A boat having a transom and including:

a hull extension shaped to form a continuous rearward extension beyond said transom of the underside of the hull of said boat;

said hull extension comprising a hollow body having a substantially flat surface, a forward end and a bottom surface shaped to conform to the shape of an underside portion of the hull of said boat;

means providing a pivoted connection between a forward portion of said hull extension top surface and the transom to allow pivotation of said hull extension between (1) a lowermost position in which said forward end of said hull extension is continuous and in face-to-face abutment with said transom and in which said bottom surface of said hull extension is disposed adjacent and in contiguous alignment with said boat hull underside portion and (2) a raised position in which said hollow body top surface is disposed at least substantially adjacent and facing said transom;

said hull extension bottom surface being upwardly and rearwardly inclined from the bottom of said transom to at least the waterline of said boat hull to establish substantially laminar water flow when said extension is in its lowermost position, and means for pivoting said hull extension between said raised and lowermost positions.

4. A boat as claimed in claim 3, wherein said pivoting means comprise a hydraulic ram comprising a cylinder inboard of said transom and a piston rod extending through an opening in said transom, means for pivotally connecting said piston rod to said hull extension upper surface at a position aft of said hull extension forward portion and means for pivotally connecting said cylinder to said transom, means being provided for slidably sealing said transom to said piston rod at said transom opening.

5. A boat as claimed in claim 3, wherein said hull extension bottom surface is of streamlined shape to reduce drag at the stern of said boat.

6. A boat as claimed in claim 3, wherein said hull extension comprises an outer skin defining a hollow interior and including top and bottom walls and a plurality of reinforcements extending between said top and bottom walls.

7. A boat as claimed in claim 3, wherein said hull extension extends the width of the stern of said hull at the location at which said hull extension is secured to said hull.

8. A boat as claimed in claim 3, in which said pivoted connection means is located above the water line of said hull.

9. A boat as claimed in claim 3, in which said hull extension, when in its raised position, is located above the water line of said hull.

* * * * *